US007571667B2

(12) United States Patent
Halse

(10) Patent No.: US 7,571,667 B2
(45) Date of Patent: Aug. 11, 2009

(54) POWER TONG

(75) Inventor: Helge-Ruben Halse, Kristiansand S. (NO)

(73) Assignee: V-Tech AS, Kristiansand (NO)

( * ) Notice: Subject to any disclaimer, the term of this patent is extended or adjusted under 35 U.S.C. 154(b) by 0 days.

(21) Appl. No.: 10/578,983

(22) PCT Filed: Nov. 19, 2004

(86) PCT No.: PCT/NO2004/000355

§ 371 (c)(1),
(2), (4) Date: Aug. 8, 2006

(87) PCT Pub. No.: WO2005/052306

PCT Pub. Date: Jun. 9, 2005

(65) Prior Publication Data

US 2007/0074606 A1 Apr. 5, 2007

(30) Foreign Application Priority Data

Nov. 25, 2003 (NO) ..... 20035234

(51) Int. Cl.
*B25B 17/00* (2006.01)
*B25B 13/50* (2006.01)

(52) U.S. Cl. ..... 81/57.16; 81/57.19; 81/57.21

(58) Field of Classification Search ..... 81/57.16, 81/57.19, 57.21, 57.33, 57.34, 57.39, 57.44
See application file for complete search history.

(56) References Cited

U.S. PATENT DOCUMENTS 2,923,192 A * 2/1960 Montgomery et al. ..... 81/57.44
3,680,412 A * 8/1972 Mayer et al. ..... 81/57.34
3,691,875 A 9/1972 Geczy et al.
4,246,809 A * 1/1981 Keast et al. ..... 81/57.16
4,309,922 A * 1/1982 Beckley et al. ..... 81/57.16
4,321,975 A * 3/1982 Dyer ..... 175/206
4,567,952 A * 2/1986 Lemaire et al. ..... 173/164
4,791,999 A 12/1988 Skeie
4,979,356 A * 12/1990 Vatne ..... 81/57.16
5,081,888 A * 1/1992 Schulze-Beckinghausen ..... 81/57.16
5,172,613 A * 12/1992 Wesch, Jr. ..... 81/57.33
5,211,681 A * 5/1993 Penisson ..... 81/57.19
6,213,216 B1 4/2001 Rogers
6,223,629 B1 5/2001 Bangert
6,253,643 B1 * 7/2001 Buck ..... 81/57.33
6,598,501 B1 * 7/2003 Schulze-Beckinghausen et al. ..... 81/57.34

FOREIGN PATENT DOCUMENTS

GB 2352667 2/2001
WO WO 00/45027 8/2000
WO WO 01/51763 7/2001

OTHER PUBLICATIONS

Intl Prel Rpt Nov. 24, 2005.
Written Opinion Mar. 29, 2005.

* cited by examiner

*Primary Examiner*—Hadi Shakeri
(74) *Attorney, Agent, or Firm*—Gable Gotwals

(57) ABSTRACT

A power tong for use during installation and dismantling of pipes when drilling in the ground, such as is known from e.g. petroleum production, comprising a drive ring and at least one clamping device, where the clamping device is arranged to grip a pipe string, the power tong being equipped with a driving mechanism for rotation of the clamping device about the longitudinal axis of the pipe string, and where the clamping device communicates with a fluid supply via a swivel ring that encircles the drive ring.

17 Claims, 7 Drawing Sheets

III-III

POWER TONG

REFERENCE TO PENDING APPLICATIONS

This application claims the benefit of PCT/NO04/00355, filed Nov. 19, 2004, which claimed the benefit of Norway Application No. 20035234, filed Nov. 25, 2003.

BACKGROUND OF THE INVENTION

This invention regards a power tong. More particularly, it regards a power tong without a radial opening, the power tong being particularly well suited for use during installation of piping when drilling in the ground, such as is known from e.g. petroleum production. The tong has a swivel coupling surrounding the tong for transferring pressurized fluid from an external source of pressurized fluid to the tong when the tong rotates about the longitudinal axis of the pipe.

It is known, among other things from petroleum production, to use power tongs for installing and dismantling lengths of piping to or from a pipe string associated with a drilling rig. It is common to use mechanical pipe tongs that, following the screwing or unscrewing of a pipe joint, on the whole are moved horizontally away from the pipe string, the pipe string being located at the drilling centre of the drill rig.

This method is dependent on the power tong having a radial opening, whereby the power tong can be displaced in the horizontal plane when being removed from the pipe string.

Having this type of radial opening in a power tong that has to be able to rotate about the longitudinal axis of the pipe obviously complicates the design of the power tong. The opening weakens the structure surrounding the pipe considerably. As a result, the structure must be up-rated in order to accommodate the relatively large forces being transferred between the power tong and the pipe string. A relatively complicated mechanical device is required to close the radial opening when the power tong is in use, and in many cases also to transfer forces between the sides of the opening.

The object of the invention is to remedy or diminish at least one of the disadvantages of prior art.

The object is achieved in accordance with the invention, by the characteristics stated in the description below and in the following claims.

BRIEF SUMMARY OF THE INVENTION

According to the invention the power tong is provided with an undivided drive ring enclosing the vertical central axis of the drilling centre. The drive ring has been given a relatively large inner diameter so as to allow movement of e.g. drilling tools having a considerably larger outer diameter than the pipe string, through the power tong.

The drive ring is rotatably supported in the power tong housing and is preferably driven in a manner that is known per se, by at least one hydraulic motor.

In the drive ring there is provided at least one pressurized fluid driven radially displaceable clamping device (clamp). Most preferably there is a plurality of clamps distributed around the pipe in two groups. Each group of clamps is removably attached to the drive ring, each group of clamps being arranged so as to allow it to be lifted out of the drive ring in connection with e.g. maintenance or movement of a large object through the power tong.

Pressurized fluid from a pressurized fluid system connected thereto is delivered to the fluid cylinders of the clamps via a swivel coupling that sealingly encircles the drive ring.

The swivel ring of the swivel coupling is stationary with respect to the power tong housing.

It is greatly advantageous for the clamp in the inactive position to be retracted relative to the pipe string, among other things to prevent sparking between the pipe string and the clamps during drilling. Thus, in a preferred embodiment, the swivel coupling is provided with a first passage that communicates with the plus side of the fluid cylinders, a second passage that communicates with the minus side of the fluid cylinders, and also a drainage duct.

Preferably the parts of the clamps abutting the pipe have replaceable grippers. Gripper sets can be manufactured in different shapes and sizes, allowing them to be adapted to the pipe dimension in question and the desired geometry of engagement between the gripper and the pipe string. The invention allows the clamps to be moved relatively far back relative to the pipe string.

In a preferred embodiment the power tong constitutes an upper installation tong in a joint assembly with an underlying back-up tong. The joint assembly is connected to a horizontally displaceable chassis by means of vertical guides, to allow the joint assembly to be moved away from the drilling centre.

The heights of the power tong and the back-up tong are mutually adjustable to compensate for the relative axial displacement of the pipes during screwing and unscrewing, and in order to allow work to be carried out between the tongs. Preferably weight-compensating cylinders are provided between the power tong and the back-up tong in order to take up weight when screwing sensitive threads.

Most preferably there is provided between the power tong and the back-up tong a collecting device for drilling fluid. The collecting device is connected to a mud outlet.

Preferably the back-up tong can be provided with a traversing lifting device on the underside, to make it possible to lift e.g. the slips etc.

The time it takes to tie in and dismantle pipes will be reduced when compared with prior art, as the time spent moving the power tong to and from the drilling centre no longer applies. The comparatively simple construction of the power tong results in improved reliability and lower maintenance costs.

All spinning and force operations are performed by use of the tong, so there is no need to use a separate so-called spinner.

The structure is compact and does not require a lot of space in the longitudinal direction of the pipe string. It is well suited for building in cleaning and lubricating equipment for the pipe thread.

DESCRIPTION OF THE DRAWINGS

The following describes a non-limiting example of a preferred embodiment illustrated in the accompanying drawings, in which.

DETAILED DESCRIPTION OF THE INVENTION

Figure 1:
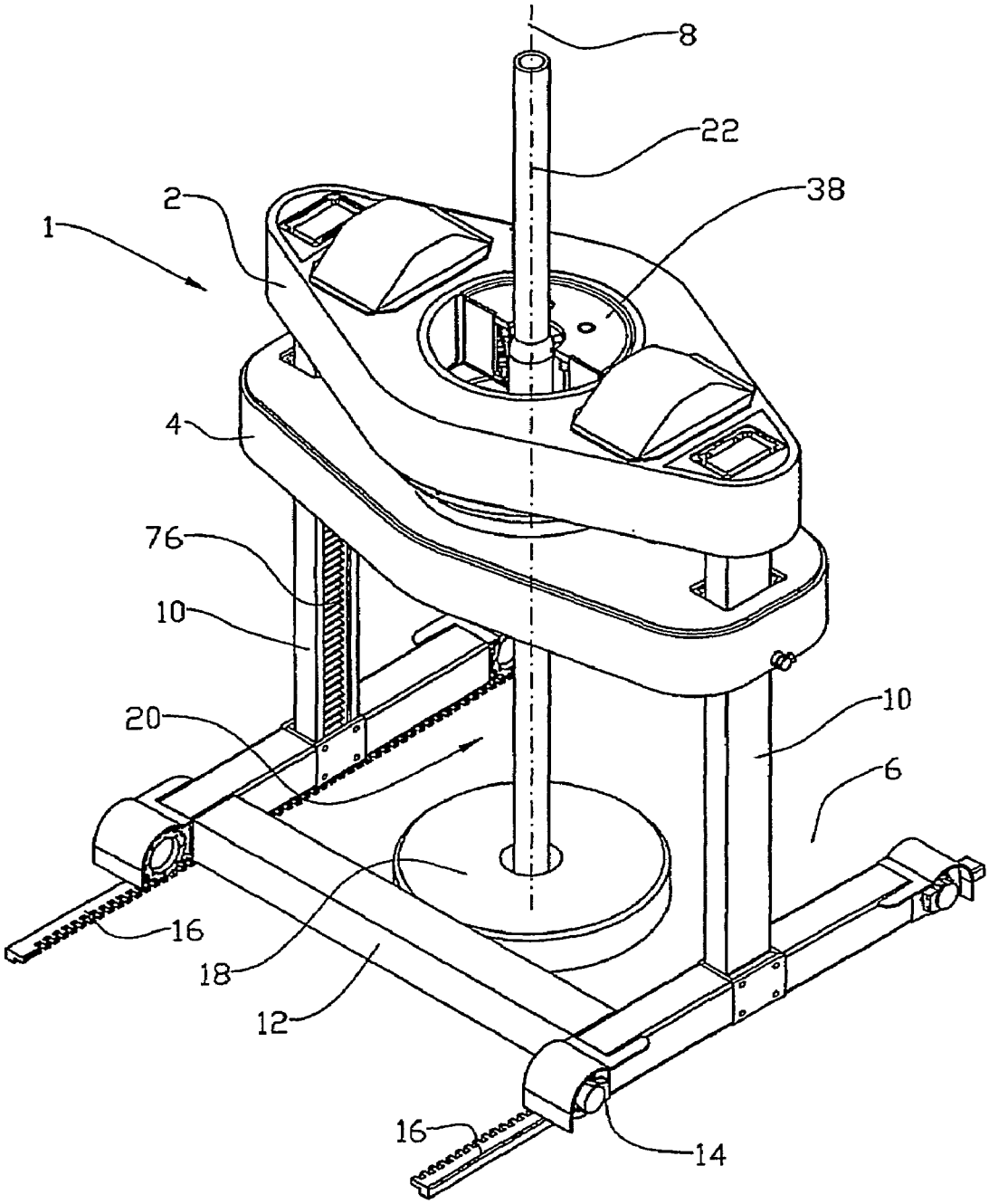
FIG. 1 is a perspective view of a joint assembly of a power tong, in which a group of clamps has been removed for illustrative purposes, and a back-up tong on a horizontally displaceable chassis, where the assembly has been moved to its upper position.

In the drawings reference number 1 denotes a joint assembly of a power tong 2 and a back-up tong 4 located on a drilling rig 6 coaxially with the drilling centre 8 of the drilling rig 6. The assembly 1 is coupled in a vertically displaceable manner to two guide columns 10 arranged diametrically opposite each other relative to the drilling centre 8.

The guide columns 10 are connected to a chassis 12 which by means of wheels 14 and hydraulic motors (not shown) can be displaced horizontally on rails 16 connected to the drilling rig 6.

Thus, in the operative position the assembly 1 is located immediately above the slips 18 of the drilling rig 6, a pipe string 20 projecting up through the slips 18 and on up through the assembly 1. The pipe string 20 consists of screwed-together lengths 22 of piping.

Figure 3:
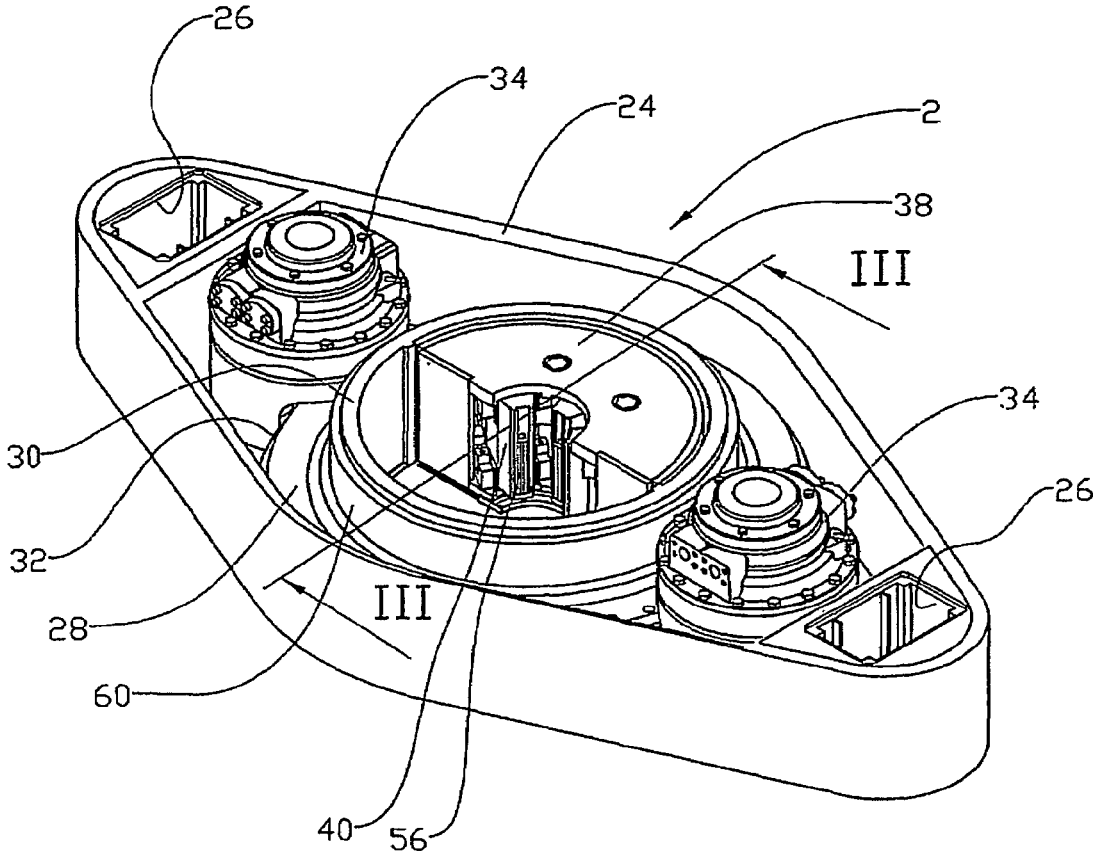
FIG. 3 is a perspective view of the power tong with the cover removed, on a larger scale.
Figure 4:
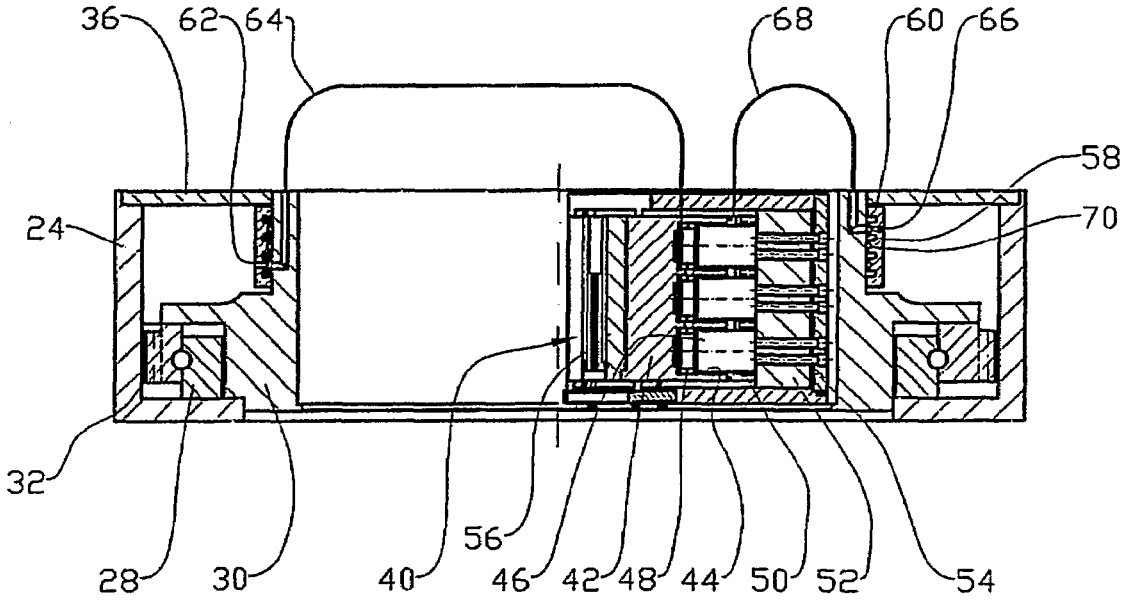
FIG. 4 shows a section III-III through FIG. 3.

The power tong 1, see FIGS. 3 and 4, comprises a power tong housing 24 provided with a through aperture 26 that corresponds to the guide columns 10, and an undivided drive ring 30 connected via bearing ring 28. The bearing ring 28 has a toothed ring 32 in mesh with cogwheels (not shown) on two hydraulic motors 34. The toothed ring 32 is coupled to the drive ring 30 by screw-bolt-joints (not shown). Thus the hydraulic motors 34 are arranged to rotate the drive ring 30 about the drilling centre 8. Mechanically it is preferable for the two hydraulic motors 34 to be disposed on diametrically opposite sides of the drive ring 30.

A cover 36 is provided to cover the power tong housing 24.

In the drive ring 30 and co-rotating with this are two crescent-shaped groups 38 of clamps, of which only one is shown in the drawings, for illustrative purposes.

Each group 38 of clamps is typically provided with three clamps 40 distributed around the drilling centre 8. A clamp 40 comprises a cylinder block 42 provided with three cylinder bores 44 arranged in a vertical row. In each cylinder bore 44 is a corresponding axially displaceable piston 46 that seals against the cylinder bore 44 by means of a piston gasket 48. A rear gasket 50 prevents pressurized fluid from flowing out between the piston 46 and the cylinder bore 44 at the rear end of the piston 46.

The pistons are removably attached to the housing 52 of the group 38 of clamps by means of respective screw-bolt-joints 54.

On the part of the cylinder block 42 facing the drilling centre 8 there is provided a gripper 56. The gripper 56 may be connected to the cylinder block 42 by means of dovetail grooves or screw-bolt-joints (not shown).

Surrounding the drive ring 30 there is provided a swivel ring 60 that seals by means of swivel gaskets 58, the swivel ring 60 being stationary relative to the power tong housing 24. The swivel ring 60 has a first passage 62 that communicates with the plus side of the pistons 46 via a first fluid connection 64, a second passage 66 that communicates with the minus side of the pistons 46 via a second fluid connection 68, and a further passage 70. The cylinder 44 and the piston 46 are thereby double acting.

The swivel ring 60, swivel gaskets 58 and drive ring 30 together form a swivel coupling.

Figure 5:
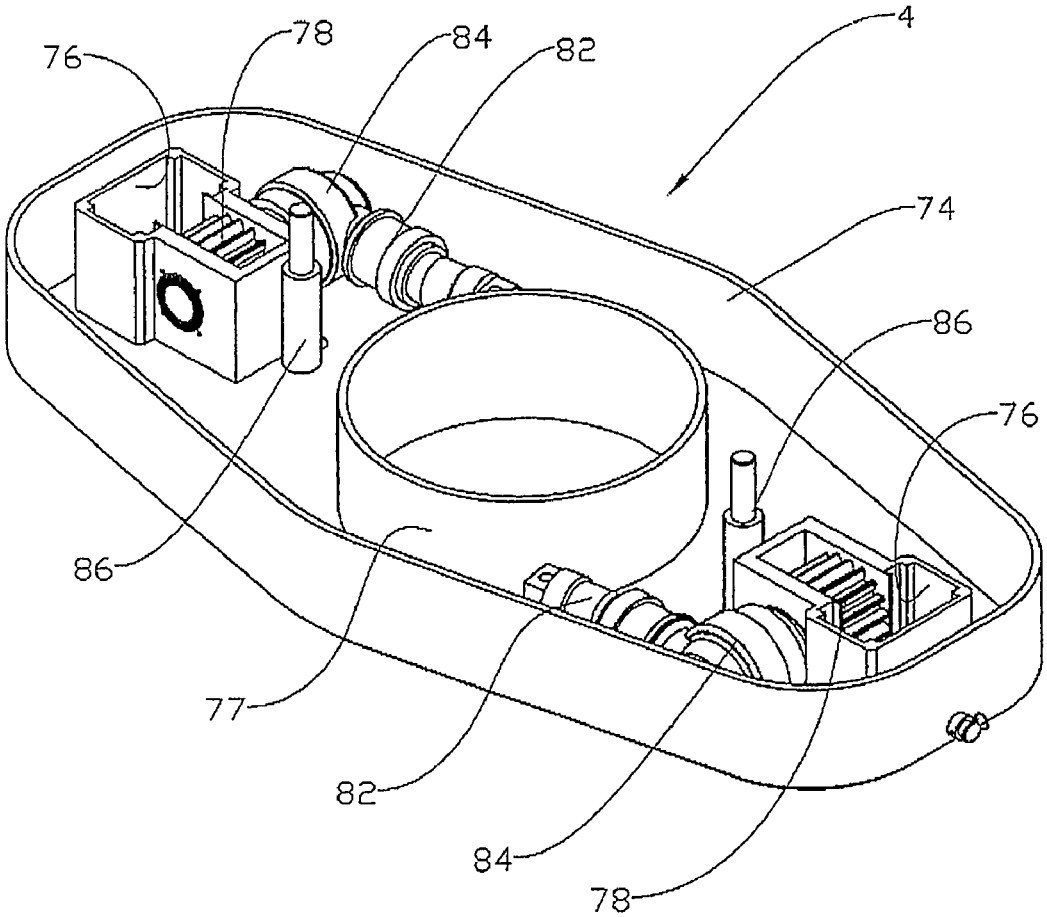
FIG. 5 is a perspective view of the back-up tong with the cover and groups of clamps removed, on a larger scale.

The back-up tong 4 comprises a back-up tong housing 74 with guides 76 that correspond with the guide columns 10, and a retainer ring 77 for two groups of clamps (not shown in this drawing). At the guides 76 there are cogwheels 78 that mesh with respective pitch racks 80 of the guide columns 10, see FIG. 5.

Separate hydraulic motors 82 drive the cogwheels 78 via gears 84.

A pair of hydraulic cylinders 86 are arranged to adjust the vertical distance between the power tong 2 and the back-up tong 4.

Figure 6:
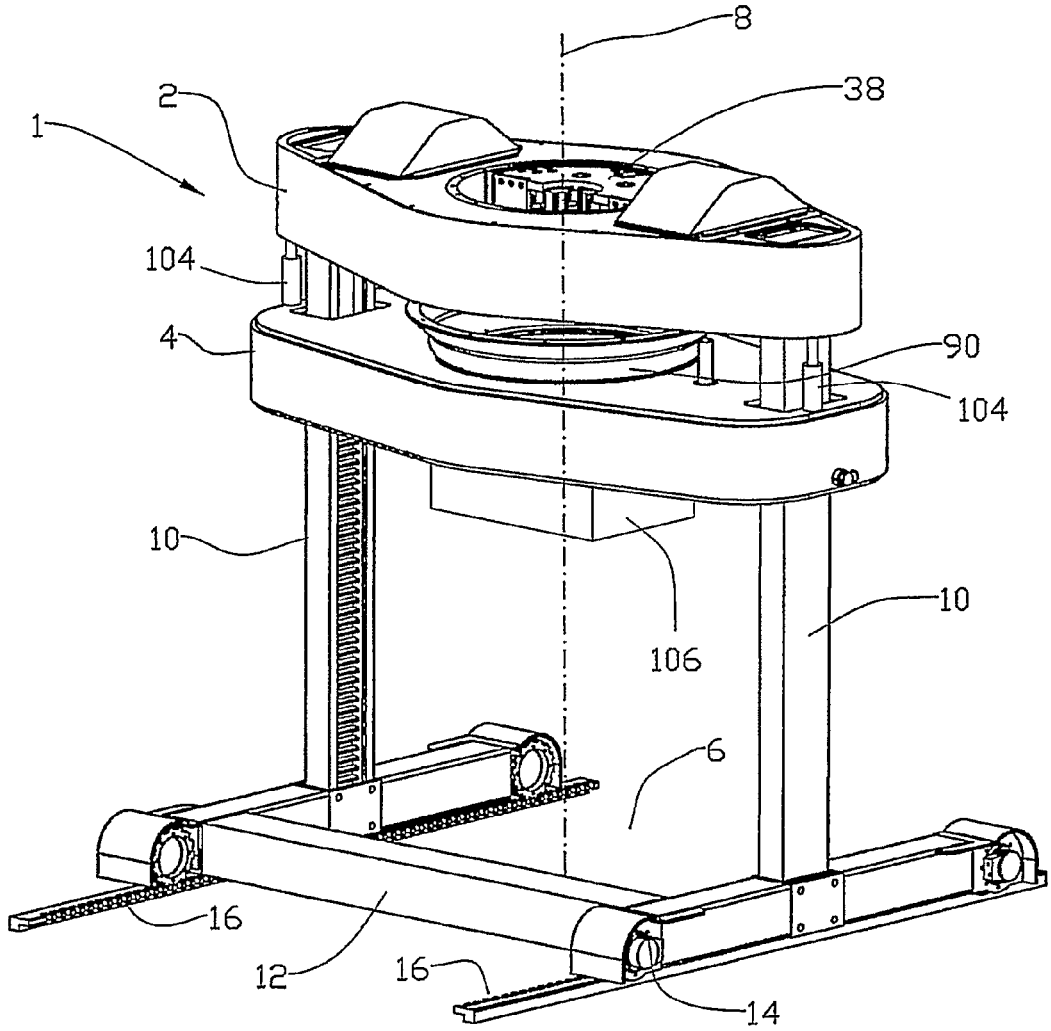
FIG. 6 shows the same as FIG. 1 but here the back-up tong has been moved downwards slightly relative to the power tong.

A collecting device comprises a collecting bellows 90, see FIG. 6. The collecting bellows 90 is arranged to seal between the power tong 2 and the back-up tong 4.

Figure 7:
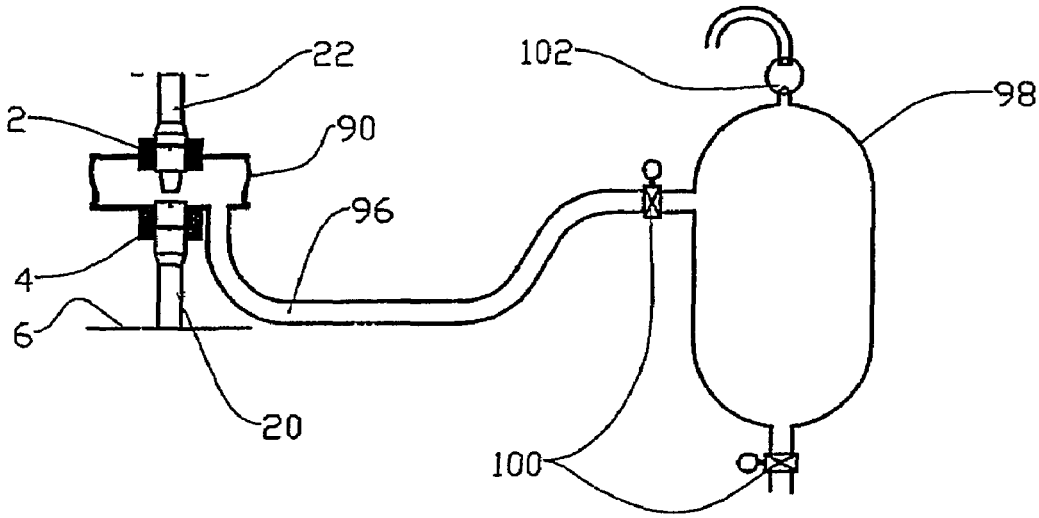
FIG. 7 is a schematic representation of the drilling fluid collecting device.

The collecting device is drained via a pipe 96 to a vacuum tank 98, see FIG. 7. The vacuum tank 98 is filled and drained in a manner that is known per se, by use of valves 100 and a vacuum pump 102.

When a length 22 of piping is to be joined to the pipe string 20 the assembly 1 is displaced vertically along the guide columns 10 by means of the hydraulic motors 82, the gears 84, the cogwheels 78 and the pitch racks 80 until the back-up tong 4 corresponds with the upper socket part (not shown) of the pipe string 20 in a known manner. The vertical distance between the back-up tong 4 and the power tong 2 is adjusted so as to make the grippers 56 correspond with the lower socket part of the length 22 of piping.

The clamps 40 are moved up to the length of piping by pressurized fluid flowing to the first passage 62 in the swivel ring 60 and on through the first fluid connection 64 to the plus side of the pistons 46. The excess fluid on the minus side of the pistons 46 flows via the second fluid connection 68 and the second passage 66 back to a hydraulic unit (not shown).

The grippers 56 then grip their respective piping sections while the hydraulic motors 34 rotate the drive ring 30 and the groups 38 of clamps about the drilling centre 8, while at the same time constant pressure is applied through the swivel ring 60 to the plus side of the pistons 46.

The power tong 2 is displaced down towards the back-up tong 4 while the screwing takes place.

After the desired tightening moment has been achieved, the rotation of the drive ring 30 is stopped. The clamps 40 are retracted from the pipe string 20 by pressurized fluid being delivered to the minus side of the pistons 46 via the swivel ring 60.

Figure 2:
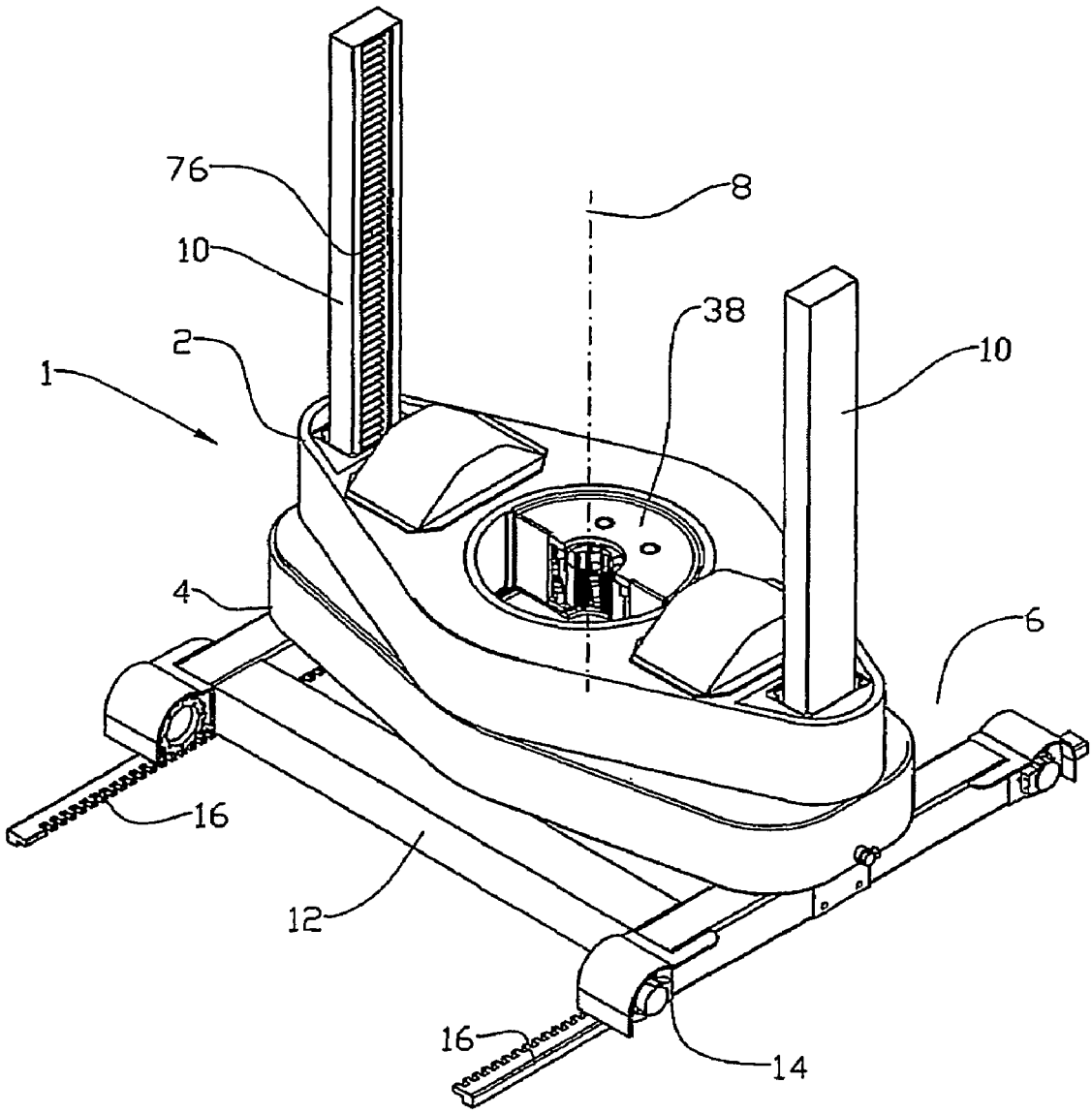
FIG. 2 shows the same as FIG. 1 but here the joint assembly is in its lower position.

Thus the joint assembly 1 is released from the pipe string 20 to be displaced to its lower position if desired, see FIG. 2.

When a length 22 of piping is to be detached from the pipe string 20 the operation is performed in a similar manner to that described above. The collecting bellows 90 collects drilling fluid that is present in the length 22 of piping, and which flows out when the length 22 of piping is disconnected. The collected fluid flows via pipe 96 to the vacuum tank 98.

When drilling tools or other objects of a larger outer diameter than the pipe string 20 are to be displaced through the assembly 1, the grippers 56 can easily be removed from their respective clamps 40, or alternatively the groups 38 of clamps can be lifted out of the drive ring 30.

Weight-compensating cylinders 104 may be provided between the power tong 2 and the back-up tong 10 in order to take up weight when screwing sensitive threads. A schematic representation of these weight-compensating cylinders 104 is shown in FIG. 6.

The back-up tong 10 may also be provided with a traversing lifting device 106 on the underside, to make it possible to lift. e.g., the slips. etc. A schematic representation of a traversing lifting device 106 is shown in FIG. 6.

The invention claimed is:

1. A power tong for use during installation and dismantling of pipes when drilling in the ground, said power tong comprising a drive ring and at least one clamping device where the clamping device is arranged to grip a pipe string, the power tong being equipped with a driving mechanism for rotation of the clamping device about a longitudinal axis of the pipe string, and where the clamping device communicates with a fluid supply via a swivel ring that encircles the drive ring, and a plurality of the clamping devices are gathered in a group, where the group of clamping devices are removable from the drive ring;

the clamping device having at least one piston in a cylinder, the piston communicating with the fluid supply via the swivel ring that encircles the drive ring, the cylinder and the piston are double acting, wherein a plus side of the piston is in communication with a first passage in the swivel ring; and a minus side of the piston is in communication with a second passage in the swivel ring.

2. A power tong in accordance with claim 1, the clamp device further comprising a removable gripper.

3. A power tong in accordance with claim 1 further comprising a back-up tong.

4. A power tong in accordance with claim 3, further comprising the power tong together with the back-up tong being vertically displaceable along at least two guide columns.

5. A power tong in accordance with claim 4, further comprising the guide columns are disposed on diametrically opposite sides of the pipe string.

6. A power tong in accordance with claim 4, further comprising the power tong and the back-up tong being independently displaceable vertically.

7. A power tong in accordance with claim 3, further comprising a space between the power tong and the back-up tong shielded by a collecting bellows, the collecting bellows being positioned so as to collect a content of the pipe.

8. A power tong in accordance with claim 3, further comprising the power tong and the back-up tong being displaceable vertically on a chassis.

9. A power tong in accordance with claim 3, further comprising the power tong and the back-up tong being horizontally displaceable along a chassis.

10. A power tong in accordance with claim 1, further comprising the drive ring being in connection to more than one motor.

11. A power tong in accordance with claim 1, further comprising at least one weight compensation cylinder between the power tong and the back-up tong.

12. A power tong in accordance with claim 1, the backup tong further comprising a lifting device.

13. A power tong in accordance with claim 1, further comprising pipe thread cleaning and lubrication equipment.

14. A power tong in accordance with claim 1, wherein said group of clamping devices comprising a plurality of clamps.

15. A power tong in accordance with claim 1, each of the clamps comprising a hydraulic cylinder and a hydraulic piston operable to open and close the clamp.

16. A power tong in accordance with claim 15, further comprising the hydraulic cylinder and piston being removable from the drive wheel with the drive wheel installed in the power tong.

17. A power tong in accordance with claim 1, further comprising the drive ring being undivided.

* * * * *